US011028547B2

(12) United States Patent
Werz et al.

(10) Patent No.: US 11,028,547 B2
(45) Date of Patent: Jun. 8, 2021

(54) AVALANCHE SHOVEL AND TENT

(71) Applicant: Werz Innovations GmbH, St. Johann (DE)

(72) Inventors: Matthias Werz, Engstingen (DE); Andreas Reiter, Grafing (DE)

(73) Assignee: Werz Innovations GmbH, St. Johann (DE)

( * ) Notice: Subject to any disclaimer, the term of this patent is extended or adjusted under 35 U.S.C. 154(b) by 0 days.

(21) Appl. No.: 16/639,791

(22) PCT Filed: Dec. 20, 2017

(86) PCT No.: PCT/EP2017/083704
§ 371 (c)(1),
(2) Date: Feb. 18, 2020

(87) PCT Pub. No.: WO2019/034270
PCT Pub. Date: Feb. 21, 2019

(65) Prior Publication Data

US 2020/0190755 A1 Jun. 18, 2020

(30) Foreign Application Priority Data

Aug. 18, 2017 (DE) ..... 10 2017 118 887.8

(51) Int. Cl.
*E01H 5/02* (2006.01)
*A63B 29/08* (2006.01)
(Continued)

(52) U.S. Cl.
CPC ..... *E01H 5/02* (2013.01); *A63B 29/021* (2013.01); *A63B 29/08* (2013.01); *B25G 1/04* (2013.01);
(Continued)

(58) Field of Classification Search
CPC ..... A63B 29/08; A63B 29/021; E01H 5/02
See application file for complete search history.

(56) References Cited

U.S. PATENT DOCUMENTS 6,003,915 A 12/1999 Bierman
8,387,188 B2 3/2013 Murphy
(Continued)

FOREIGN PATENT DOCUMENTS

CH 663542 A * 12/1987 ..... A63B 29/021
CH 663542 A5 12/1987
(Continued)

OTHER PUBLICATIONS

German Office Action dated Mar. 31, 2020 issued in the corresponding German Application No. 10 2017 118 887.8 (with English translation of the relevant parts).
(Continued)

*Primary Examiner* — Noah Chandler Hawk
(74) *Attorney, Agent, or Firm* — Collard & Roe, P.C.

(57) ABSTRACT

An avalanche shovel has a shaft and a grip section that is formed and/or arranged at one shaft end The avalanche shovel has an avalanche probe which can be arranged in the shaft of the avalanche shovel, wherein the grip section exhibits a grip area for gripping and/or holding the avalanche shovel and/or such a grip area is formed on the grip section. The grip section exhibits an insertion and/or removal opening for removal from and/or for insertion of the avalanche probe into the shaft along an insertion axis. A tent can have the avalanche shovel as a tent pole.

20 Claims, 11 Drawing Sheets

(51) Int. Cl.

| | |
|---|---|
| ***A63B 29/02*** | (2006.01) |
| ***B25G 1/04*** | (2006.01) |
| ***B25G 1/08*** | (2006.01) |
| ***B25G 1/10*** | (2006.01) |
| ***E04H 15/60*** | (2006.01) |
| *B25G 3/24* | (2006.01) |

(52) U.S. Cl.
CPC ..... *B25G 1/08* (2013.01); *B25G 1/10* (2013.01); *E04H 15/60* (2013.01); *A63B 2210/50* (2013.01); *B25G 3/24* (2013.01)

(56) References Cited

U.S. PATENT DOCUMENTS

| | | | |
|---|---|---|---|
| 9,339,093 | B1 | 5/2016 | Porter |
| 2008/0179904 | A1 | 7/2008 | Huang |

FOREIGN PATENT DOCUMENTS

| | | | | |
|---|---|---|---|---|
| DE | 19908329 | A1 | 8/2000 | |
| DE | 202007001047 | U1 | 3/2007 | |
| DE | 202006019270 | U1 | 6/2007 | |
| EP | 0191917 | B1 * | 7/1990 | ..... B25D 7/00 |
| FR | 402726 | A | 10/1909 | |

OTHER PUBLICATIONS

English Translation of the International Preliminary Report on Patentability for PCT/EP2017/083704 dated Feb. 27, 2020.
International Search Report of PCT/EP2017/083704 dated May 15, 2018.

* cited by examiner

AVALANCHE SHOVEL AND TENT

CROSS REFERENCE TO RELATED APPLICATIONS

This application is the National Stage of PCT/EP2017/083704 filed on Dec. 20, 2017, which claims priority under 35 U.S.C. § 119 of German Application No. 10 2017 118 887.8 filed on Aug. 18, 2017, the disclosures of which are incorporated by reference. The international application under PCT article 21(2) was not published in English.

BACKGROUND OF THE INVENTION

The invention relates to an avalanche shovel having a shaft, a grip section being formed and/or arranged at one shaft end, and having an avalanche probe that can be arranged in the shaft of the avalanche shovel, the grip section exhibiting a grip area for gripping and/or holding the avalanche shovel and/or such a grip area is formed on the grip section. Furthermore, the invention relates to a tent having an avalanche shovel according to the invention as a tent pole.

A snow shovel with a bar probe is known from utility model DE 20 2007 001 047 U1. The bar probe can be arranged in the shaft of the snow shovel described there. The shaft is made of several parts. To remove the probe, the shovel shaft must be disassembled.

A hollow shovel handle with an integrated rod for searching for people buried in an avalanche is known from CH 663542A5. This shovel handle is made in one piece and can therefore not be pushed together for transport purposes or adjusted in length when working.

In general, it is recommended to carry emergency equipment in alpine, especially snow-covered, areas. Such emergency equipment typically includes, among other things, an avalanche shovel and an avalanche transceiver (LVS), and an avalanche probe. A bivouac sack that is used in emergencies, such as strong storms or an overnight stay in alpine terrain, complements this standard equipment.

An avalanche transceiver enables a buried person to be located using an electromagnetic signal. If the search distance can no longer be reduced using avalanche transceivers, the point location begins with an avalanche probe that is inserted through the snow masses. If the victim can be probed, the rescue begins with avalanche shovels.

The avalanche shovels available on the market, in addition to construction and use of materials, differ in their telescopic properties. Higher-quality shovels offer an extension mechanism that allows the user to extend the shovel and thus achieve better leverage and increased shoveling comfort.

Previous avalanche shovels with telescopic mechanisms have a spring construction. This spring mechanism is located inside the shovel shaft. There are nipples on both ends of this spring. These nipples protrude from the shaft through holes in the shovel shaft. By pressing these nipples, the spring mechanism inside the shovel is compressed and the shovel can be extended.

An avalanche probe consists of several sections and can be assembled by aligning the parts and tightening a cable that is guided through them within these parts. The cable is clamped by means of a mechanism, so that the probe cannot collapse.

Bivouac sacks for tourers and freeriders are offered as emergency equipment by various manufacturers and differ primarily in the materials used. The thin fabric in the form of a sleeping bag or an emergency blanket is stored in a small bag and is used to maintain body temperature in an emergency. Some models have an aluminum coating on the inside and reflect most of one's own body heat. Due to their small pack size, bivouac sacks are ideal for long tours because they do not take up much space in the backpack, but have the disadvantage that the user is directly exposed to the weather and offer no protection for the equipment due to the small size. Since tourers and freeriders pay great attention to the weight of the equipment to be carried, bivouac sacks are widespread.

In contrast to a bivouac sack, a winterproof tent has the great advantage that it offers more protection against cold and weather. Hypothermia can occur quickly in the bivouac sack, especially in the head area. Furthermore, a tent offers space for equipment such as a backpack, in which clothes can be stowed. A backpack cannot be accommodated in a bivouac sack and is therefore exposed to weather conditions. You can also change your wet clothes in a tent and boil water in an emergency.

For a comfortable alpine experience, it is desirable that such emergency equipment can be transported in a space-saving and lightweight manner. In the event of an emergency, for example, in the event of an avalanche, the emergency equipment components should also be quickly and safely manageable.

In particular, the avalanche shovel, because of its size and weight, is of special significance.

SUMMARY OF THE INVENTION

The object of the invention is therefore to offer an avalanche shovel with improved functionality, so that emergency equipment equipped with such a shovel can be made more compact and lighter and the elements of the emergency equipment are quickly within reach.

The object is achieved by an avalanche shovel having a shaft, wherein a grip section is formed and/or arranged at one shaft end, and having an avalanche probe which can be arranged in the shaft of the avalanche shovel, wherein the grip section exhibits a grip area for gripping and/or holding the avalanche shovel and/or such a grip area is formed on the grip section, wherein the grip section exhibits an insertion and/or removal opening for removal from and/or for insertion of the avalanche probe into the shaft along an insertion axis.

The avalanche probe can thus be inserted into and removed from the avalanche shovel through the insertion and/or removal opening. It is not necessary to dismantle the avalanche shovel, especially the grip section. The avalanche probe can thus be deployed quickly. The avalanche shovel can remain fully usable even when the avalanche probe is removed.

The shaft can be hollow at least in sections, so that the avalanche probe can be arranged in the shaft.

The avalanche probe arranged in the shaft can preferably reach as far as the end of the shaft provided with the grip section so that it can be removed easily.

The removal from or insertion of the avalanche probe into the shaft can be facilitated if the grip area is arranged and/or configured outside the insertion axis.

For this purpose, the grip section, in particular the grip area, can be arranged and/or formed at an angle to the insertion axis.

It can be provided that the grip section, in particular the grip area, is D-shaped or T-shaped.

For this purpose, the grip area can have a base section and a gripping surface. The base section can in particular correspond to the straight section of a D-shaped grip area. In the case of a T-shaped grip area, the base section can be formed by a center line of the grip area. The insertion and/or removal opening can then be arranged or formed in or on the base section. The avalanche probe can thus be removed through the base section or inserted into the avalanche shovel. The gripping surface can preferably be located outside the insertion axis.

A cap can be arranged at one end of the shaft, in particular in the region of the insertion and/or removal opening. The cap can have a clamping point for the cable. Thus, the avalanche probe, together with the cap, can be removed from the shaft of the shovel and subsequently a probe consisting of several parts can then be mounted by tightening the cable passing through the probe parts and by fastening the cable to the cap.

The cap thus forms an end to the shovel shaft. Transport and/or removal of the avalanche probe can thus be simplified. The cap also facilitates removal of the avalanche probe from the avalanche shovel without having to disassemble the avalanche shovel, in particular the shaft.

It can also be provided that the grip section of the avalanche shovel exhibits at least one receptacle for the mounted avalanche probe and/or for a ski pole and/or for an ice ax or the like and/or that such a receptacle is formed on the grip section.

For this purpose, the receptacle can be designed, for example, as a slot. The receptacle can be formed from and/or comprise a textile material. A separate connecting element, for example, a clamping part, can also be provided, which exhibits at least one such receptacle, in particular a recess. The receptacle can also have a preferably tubular recess or be designed as such.

It is particularly advantageous if the avalanche shovel, in particular the grip section, exhibits several such recesses. Then, one or more avalanche probes and/or one or more ski poles can be arranged, in particular fastened, to the avalanche shovel.

As will be explained in more detail below, the avalanche probe and possibly ski poles or the like can be fastened to the handle of the avalanche shovel for tensioning of a tent through use of the receptacle, so that the avalanche shovel can serve as a tent pole.

Since ski poles can have different lengths, it is advantageous if the avalanche probe can be pivotally attached to the receptacle or the grip section.

Furthermore, a hook-shaped element can be clipped onto the receptacle or onto the grip section, to which a strap fastened to a tent can be attached in a length-adjustable manner. The hook-shaped element can rotate on the receptacle or the grip section, so that an angle adjustment of the tent strap is possible with ski poles of different lengths. At the same time, the tent can be securely tensioned through the use of the length-adjustable strap to be attached to the hook-shaped element, even with different pole lengths.

It is particularly advantageous if the shaft is variable in length. Then, for example, the avalanche shovel can be transported in a shortened state and extended for the purpose of searching and/or rescuing an avalanche victim. So working with the avalanche shovel can be more efficient.

It is particularly advantageous if the shaft can be telescoped and locked in different length positions. The length of the avalanche shovel can thus be adjusted with particular ease. A telescopic mechanism enables a simple length adjustment of the at least partially hollow shaft of the avalanche shovel, in order to improve leverage when working with the avalanche shovel, and thus improved work performance. Since the snow of an avalanche often exhibits a particularly high density and therefore large masses need to be moved, rescuing buried people is made considerably easier.

In particular, it is conceivable that the shaft exhibits a fastening device designed as a latching mechanism for setting different lengths of the shaft.

Such a latching mechanism makes it possible in a particularly simple manner to design the shaft to be variable in length, in particular telescopic, whereby space on the inside of the shaft can be kept free for receiving the avalanche probe. The shaft can have a separate fastening part on which the fastening device is arranged. In particular, it is also conceivable that a plurality of fastening devices, in particular fastening devices designed with a latching mechanism, are arranged on the shaft. It can be provided that the fastening device can be actuated from an exterior side of the shaft. Thus, the fastening device can also be operated with gloves, for example, even under adverse weather conditions.

It is also conceivable that the avalanche probe is designed in several parts, preferably at least 6 parts, for example, 7 parts. The avalanche probe can thus be stowed in the shaft, even if the shaft is set to a short, in particular its shortest, length.

Individual avalanche probe parts can be connected to one another by means of a cable. In particular, the cable can be passed through the avalanche probe parts. One end of the cable can be attached to an extendable inner tube of the last probe segment. By pulling out the inner tube, the cable can be tensioned and thus the probe can be shaped into a long rod.

The inner tube can preferably be latched in this position to the last probe segment. When the cable is not fully stretched, the probe between two of its segments can be bent. For this purpose, a second latching position is provided, which fastens the probe in a position under less tension and which allows it to bend. The probe can then be used to tension a tent roof. The bend location between the two segments can be stabilized by an angle element that can be clipped on from the outside. A base element can be provided to support the probe on the ground, into which the tip of the last probe segment can be inserted.

It is also conceivable that the avalanche shovel exhibits at least one snow anchor, preferably at least three snow anchors. The snow anchor can also be designed to fasten a tent, for example, a bivouac tent. The snow anchor therefore does not need to be packed separately for transport and can be removed with one hand in an emergency. To save weight, the snow anchor can have recesses. The snow anchor can be designed as a T-hook, so that a stormproof attachment of the tent is facilitated.

The snow anchor can be arranged on or in the shaft, in particular for transport. For this purpose, the shape of the snow anchor can be adapted to the contour of the shaft.

To attach the snow anchor to the shaft, it can be provided that the snow anchor is fastened to the shaft with a sleeve. The sleeve can be a rubber sleeve, for example. By means of the sleeve, the snow anchors can, for example, be arranged in a ring around the shaft and fastened to it.

The invention also relates to a tent, preferably a winterproof bivouac tent, with a tent tarpaulin and at least one tent pole, the tent pole being formed from an avalanche shovel according to the invention or comprising such an avalanche shovel.

Thus, with a particularly low weight and/or particularly small pack size, it is possible to carry all the necessary items of emergency equipment and to have them readily available for a possible emergency situation. There is no need to carry a separate tent pole. Pegs or other anchors for the tent can also be integrated directly on the shovel.

With the help of the shovel, a self-supporting structure can be built up which, if necessary, can also stand without further fastening and/or anchoring of the tarpaulin, for example, by pegs.

The tarpaulin can be made of a textile material. For example, it can have an aluminum coating, in particular for improving the insulation and/or for reflecting heat, in particular body heat. The tarpaulin can be packed in a bag for transport.

By using the avalanche shovel as a tent pole, the tent can be set up in a particularly stable manner. It can withstand even heavy snowstorms, for example. For this purpose, the tent pole in particular can be formed from the shaft of the avalanche shovel.

It can also be provided that at least one further tent pole is formed from the avalanche probe of the avalanche shovel or comprises it. Since the avalanche probe is carried in the avalanche shovel anyway, the number of parts additionally required for setting up the tent can thus be reduced.

It is also conceivable that at least one further tent pole is formed from a ski pole or comprises one. A ski pole is also often carried, so that weight and space can also be saved by this measure. It goes without saying that, in the sense of the invention, instead of or in addition to a ski pole, other stick-shaped objects can be used to form a tent pole. In particular, objects can be used that are typically carried on a mountain tour or the like, such as hiking sticks, walking sticks, ice axes or the like.

The avalanche probe or the ski pole or the like can be attached to the receptacle which is preferably provided on the grip section of the avalanche shovel. A connecting element can also be provided on the receptacle, with which several stick-shaped objects such as the avalanche probe and a ski pole can be connected and fastened to each other at the grip section of the avalanche shovel.

The connecting element can be designed such that length differences between a ski pole and the avalanche probe do not have to be compensated for.

This means that the tent can be set up very quickly and easily. Different types of ski poles and/or avalanche probes can be connected and/or used for setting up the tent. If the connecting element is formed on the grip section, the supporting structure can be built up without needing to carry separate connecting means.

To fasten at least one tent pole and/or to tension the tarpaulin, the tarpaulin can exhibit at least one pole receptacle, in particular for holding the avalanche probe and/or the ski pole. The pole receptacle can be designed as a slot or can also be made of a tape material. A design as hooks which are clipped into the probe is also possible. Thus, no additional components are required to fasten the tarpaulin to the tent pole, for example, and/or to tension the tarpaulin. This can speed up the setup of the tent. The risk that, for example, in an emergency situation, the tent cannot be set up or can only be set up poorly because one or more required components have been lost, can also be reduced.

It is particularly advantageous if in the tent at least two tent poles are arranged or can be arranged crossing one over the other. For this purpose, the connecting element or the grip area can have two receptacles aligned with one another at an angle, in particular at a perpendicular angle.

If the tent exhibits at least one length-adjustable strap, different ski poles, avalanche probes or the like, in particular with different lengths, can also be used as tent poles. With the help of the strap, the top of the tarpaulin can always be hung on the tent poles that are crossed and connected by the connecting element, regardless of their length, in such a way that the bivouac tent achieves its maximum internal volume.

It is advantageous if the strap is fastened or can be fastened in a length-adjustable manner to a hook-shaped element and the hook-shaped element can be clipped onto a receptacle of a grip section or onto a grip section of an avalanche shovel. The hook-shaped element can rotate on the receptacle or the grip section and thus compensate for different angular positions of the shovel when a tripod is formed with ski poles of different lengths. The tent can thus be optimally tensioned using the strap.

Alternatively, especially in the area of the highest point of the tarpaulin, a tape can be sewn onto the tarpaulin. The avalanche probe can be secured on this tape against slipping out with a counter bearing or a sewn-in or punched reinforcement. The highest point of the tripod made of sticks and a shovel can thus lie above the highest point of the tent, in particular even if the height of the tripod varies due to different length ski poles and/or avalanche probes. Differences in length can also be compensated for by the—telescopic—avalanche shovel. The sewn-in tape can be provided with a buckle at the end, which on the one hand enables the length of the tape to be adjusted and on the other hand can be attached to the avalanche shovel. The attachment can be realized using a hook. The hook can be hung in a preferably textile strap. Alternatively, or in addition, it is conceivable to provide a form-fitting suspension and/or a latching device. By length adjustment of this buckle, any remaining height difference between the tripod and tent can be adjusted. The necessary tension of the tent can be generated at the same time. Thus resistance of the tent to storms and weather can be further increased.

It is also conceivable that the grip section and/or the connecting element have straps for receiving and preferably for fastening at least one ski pole or the avalanche probe or part of the avalanche probe. The receptacles can be formed, for example, as blind holes. As an alternative, or in addition, the avalanche probe, in particular one end of the avalanche probe, can have a stepped diameter, so that the end can be received in a receptacle, for example, in the form of a circular hole.

For transport of the tent, it is also conceivable to arrange the tarpaulin, preferably in folded or rolled state, around and/or on the avalanche shovel. For example, the tarpaulin can be attached to a blade surface of the avalanche shovel by means of a strap, a slot and/or a fastening strap. The tent can thus be stored saving even more space in emergency equipment.

Overall, an avalanche shovel with a particularly large scope of use is thus made available. In particular, in addition to the typical functions of an avalanche shovel, in particular digging for avalanche victims, the avalanche shovel provides the additional functions of an avalanche probe and a tent pole. The functionality of the avalanche shovel can be further improved due to the particularly small space requirement and weight. It goes without saying that alternative embodiments of the invention are also conceivable in which one of the functions, for example, the function as a tent pole, is dispensed with. This can result, for example, when the carrying of a tent in emergency equipment is dispensed with.

By arranging several elements of emergency equipment in or on the avalanche shovel, in an emergency, the corresponding elements of the emergency equipment can be made ready for use in just a few simple steps. With the previous separate storage of these elements in a backpack, much more time is required. The backpacks of touring skiers, freeriders and other people in alpine regions are typically so highly filled that finding the elements of the emergency equipment can take a considerable amount of time, which is not available in an emergency situation.

Additional features and advantages of the invention can be found in the following detailed description of an embodiment of the invention, on the basis of the drawings, which show details essential to the invention, and in the claims.

The individual features may each be implemented in isolation or together in any desired combinations in variants of the invention. Embodiments of the invention are shown in the schematic drawings and are explained in further detail in the following description.

BRIEF DESCRIPTION OF THE DRAWING FIGURES

FIGS. 1-3 Front, side and cross-sectional views of an avalanche shovel;

FIG. 4 Individual views of components of the avalanche shovel of FIGS. 1-3;

FIG. 5 A blade surface with a tarpaulin attached to it;

FIGS. 6-8 Different embodiments of a grip section of an avalanche shovel as views of an avalanche shovel from above;

FIG. 9 A detailed view of a cap and a cable fastened to it;

FIG. 10 A top view of the cap of FIG. 9;

FIG. 11 A detailed view of an alternative embodiment of a cap and a cable fastened to it;

FIG. 12 A top view of the cap of FIG. 11;

FIGS. 13-14 Longitudinal and cross-sectional views of a fastening device;

FIGS. 15-16 Cross-sectional and longitudinal sectional views of an alternatively designed fastening device;

FIGS. 17-19 Views from above, from the side, as well as a sectional view of a tent tensioned by means of an avalanche shovel;

FIG. 20 A detailed view of the tent of FIGS. 17-19;

FIGS. 21-22 An avalanche shovel with two ski poles arranged thereon and a detailed view of a first connecting element, and FIGS. 23-24 Two ski poles connected via a second connecting element and a detailed view of the second connecting element;

FIG. 25 A perspective view of a second tent, which is tensioned by an avalanche shovel;

FIG. 26 A detailed view of the tent and the avalanche shovel from FIG. 25.

DETAILED DESCRIPTION OF THE EMBODIMENTS

For a better understanding of the invention, the same reference numbers are used in the figures for corresponding elements.

FIGS. 1, 2 and 3 show an avalanche shovel 10 from the front (FIG. 1), from the side (FIG. 2) and in cross section (FIG. 3).

The avalanche shovel 10 exhibits a shaft 12. At one end of the shaft 14, a grip section 16 is formed. The grip section 16 exhibits a grip area 18 and a base section 20. In this exemplary embodiment, the grip section 16, in particular its grip area 18, is D-shaped. In the area of the base section 20, the grip section 16 exhibits an insertion and/or removal opening 22.

An avalanche probe 24 (see in particular FIG. 3) can be inserted into or removed from the shaft 12 through this insertion and/or removal opening 22.

The direction of insertion or removal of the avalanche probe, which coincides with a longitudinal axis of the shaft 12 in this exemplary embodiment, is marked as the insertion axis 26.

From FIGS. 2 and 3, it can, in particular, be seen that the grip area 18 is arranged outside the insertion axis 26. For this purpose, the grip section 16 is inclined with respect to the insertion axis 26 at a predefined angle, here in particular in the range from 20 to 60 degrees, preferably approximately 40 degrees. The avalanche probe 24 can thus be removed from the avalanche shovel 10 without dismantling the grip section 16.

Furthermore, three snow anchors 28 are arranged on the shaft 12 by means of a sleeve 30, in particular a rubber sleeve.

A blade surface 32 is detachably fastened at the other end of the shaft 12. It can therefore be stowed separately, for example, in a backpack or the like, in particular for transport purposes.

In an alternative embodiment of the avalanche shovel according to the invention, the blade surface 32 can be fastened to the latter in at least two positions relative to the shaft 12. For example, the blade surface 32 can be arranged on the shaft 12 in the position shown in FIG. 1 and in a position rotated by 90 degrees along the longitudinal axis of the shaft 12.

FIG. 4 shows the individual parts of the avalanche shovel 10 from FIGS. 1-3 in a single representation. The shaft 12, the grip section 16 with its grip area 18 and the base section 20, the avalanche probe 24, the three snow anchors 28, the associated sleeve 30, and the blade surface 32 can again be seen.

It can, in particular, be seen that the shaft 12 consists of a first shaft part 34 and a second shaft part 36. The shaft parts 34, 36 have a diameter which is selected such that the two shaft parts 34, 36 can be pushed into one another.

Furthermore, the shaft parts 34, 36 have fastening devices 38 with fastening recesses 40. As will be explained in more detail below, the fastening device 38 with the fastening recesses 40 enable the shaft 12 to be variable in length. In particular, the shaft 12 can be compressed to a shortened state in which the avalanche shovel 10 can be transported in a particularly space-saving manner. In particular, for working with the avalanche shovel 10, the shaft 12 can be pulled apart by means of its shaft parts 34, 36 and thus extended. In order to enable safe working, the fastening device 38 with at least one fastening recess 40 ensures a latching and thus fastening of the shaft parts 34, 36 to one another.

It can also be recognized that the avalanche probe 24 is made in several parts. In particular, this exemplary embodiment exhibits seven avalanche probe parts 25. The seven-part probe forms the tightly-packed package of round profiles in a round or hexagonal outer profile. Three of these avalanche probe parts 25 can be seen in the illustration in FIG. 4.

The avalanche probe parts 25 are connected to one another by a cable 42. The cable 42 is guided through a cap 44. It is releasably fastened to the cap 44 by means of a clamping point 46 of the cap 44. In particular during the transport of the avalanche shovel 10, the fastening of the cable 42 serves to fasten the avalanche probe parts 25 within the shaft 12.

FIG. 5 shows a folded tarpaulin 48 which is fastened to the blade surface 32 by means of tensioning straps 50. FIG. 5 shows a state in which the blade surface 32 is separate from the rest of the avalanche shovel 10 (FIGS. 1-4) for transport purposes.

As will be explained in more detail, the tarpaulin 48 is used to form a bivouac tent.

It can be recognized in FIG. 5 that the—folded—tent tarpaulin is fitted into the curvature of the blade surface 32. The tarpaulin 48 can thus be transported in a particularly space-saving manner.

FIGS. 6, 7 and 8 show different embodiments of the grip section 16, as views from above of an avalanche shovel 10, i.e. using a sight line along the respective longitudinal axis or insertion axis 26 of the shaft.

In the embodiment of FIG. 6, a grip section 16 can be seen, which exhibits a D-shaped design in accordance with the avalanche shovel 10 (FIGS. 1-5).

FIG. 7 shows a T-shaped grip area 18 of the grip section 16. In this case, in particular, a cross strut is formed, which is fastened centrally on a center line 17 and which forms a T together with the center line 17.

FIG. 8 shows a further embodiment in which the grip area 18 of the grip section 16 is formed laterally, in particular on one side. In the broadest sense, the grip area 18 in this embodiment forms an L-shape together with the rest of the grip section 16.

It is common to all of the embodiments of the grip section 16 according to FIGS. 6-8 that the grip area 18 of the grip section 16 is in each case arranged outside the insertion axis 26. This enables unimpeded access to the insertion and/or removal opening 22 and thus to an avalanche probe possibly located in the shaft 12. It should also be noted that in all embodiments—regardless of whether the insertion and/or removal opening 22 is closed with a cap or not—the grip area 18 is fastened stably to the shaft 12. The risk of the grip section 16 and, in particular, the grip area 18 breaking off while working with the avalanche shovel 10 is thus significantly minimized.

FIG. 9 shows a detailed view of the cap 44 having an avalanche probe part 25. FIG. 10 shows the cap 44 in a view from above.

It is to be deduced from FIGS. 9 and 10 that the cable 42 extends through the avalanche probe part 25 and is clamped to the cap 44 by means of the clamping point 46. For this purpose, the clamping point 46 is formed with two bars around which the cable 42 is wound in a meandering shape. The avalanche probe part 25—like the other avalanche probe parts 25, not shown in FIG. 9—is hollow on the inside. The cable 42 extends through all avalanche probe parts 25 and is fastened at its other end to a last avalanche probe part 25 (not shown in FIG. 9). The cable 42 can thus be tensioned and the avalanche probe parts 25 can thereby be fastened to one another. Through use of the clamping point 46, the tension of the cable 42 can be permanently maintained by clamping.

In order to more easily place the cap 44 on the shaft 12 (FIG. 1), the cap 44 also exhibits cap recesses 52.

To fix the avalanche probe 24 in the extended state, the cable 42 is clamped to a flap 45 which is mounted in the cap 44, for example, by means of a hinge. The cable, which generates friction through the direction change in the cap 44, keeps the cap 44 or the flap 45 closed. By opening the cap or the flap 45, the clamping is released and the avalanche probe 24 can be folded up.

FIG. 11 shows an alternative embodiment of the cap 44 with a cable 42 fastened to it. FIG. 12 shows the cap 44 of FIG. 11 in a view from above.

It is to be deduced from FIGS. 11 and 12 that the cable 42 exhibits a thickening 47 in this embodiment. The thickening 47 is, for example, spherical. The cap 44 also exhibits a cable fixation 43. For this purpose, the cable fixation 43 is designed as a recess which extends through the cap 44. Its cross section exhibits a circular area with a larger radius and a circular area with a smaller radius. The cable fixation 43 is thus shaped like a keyhole. A recess is formed in the cap 44 in or on the circular region with a smaller radius.

In this embodiment, to fix the avalanche probe 25, the cable 42 is first implemented by cable fixation 43 by the circular area with a larger radius. Then it is moved to the circular area with a smaller radius. Using the recess formed there, the cable 42 can be tensioned and latched. For this purpose, the cable 42 is at least to a small extent flexible, in particular elastically stretchable.

Figure 1:
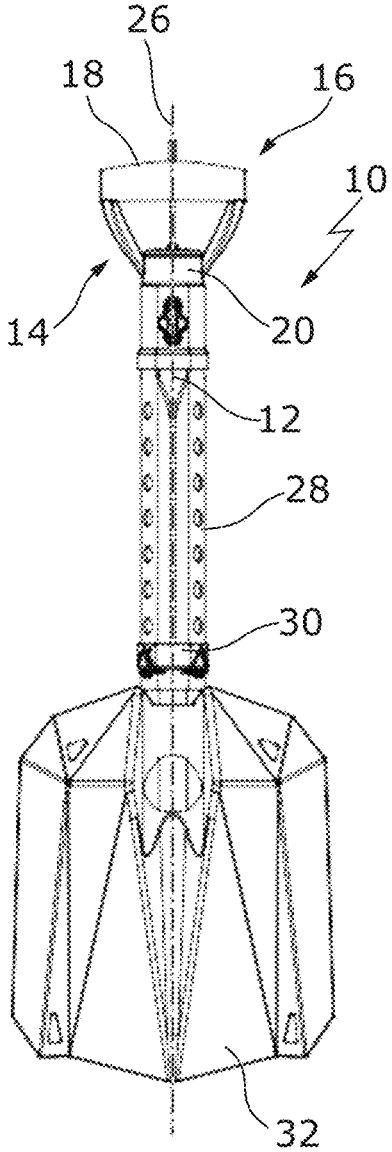
Figure 2:
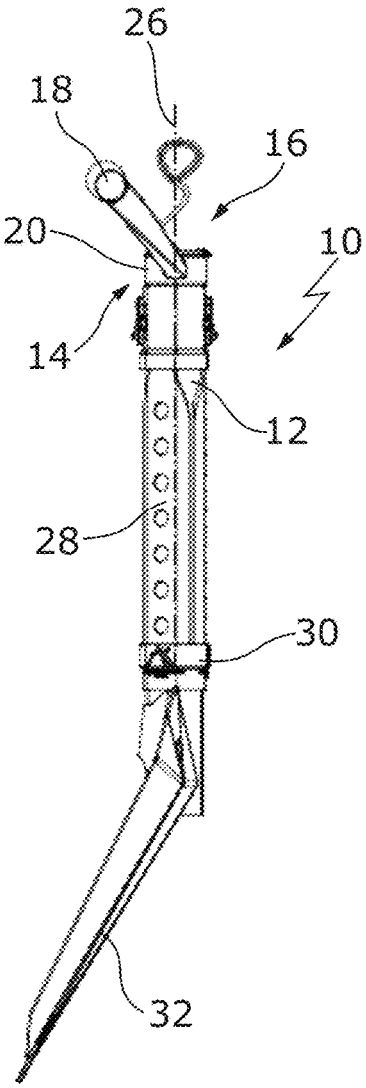
Figure 3:
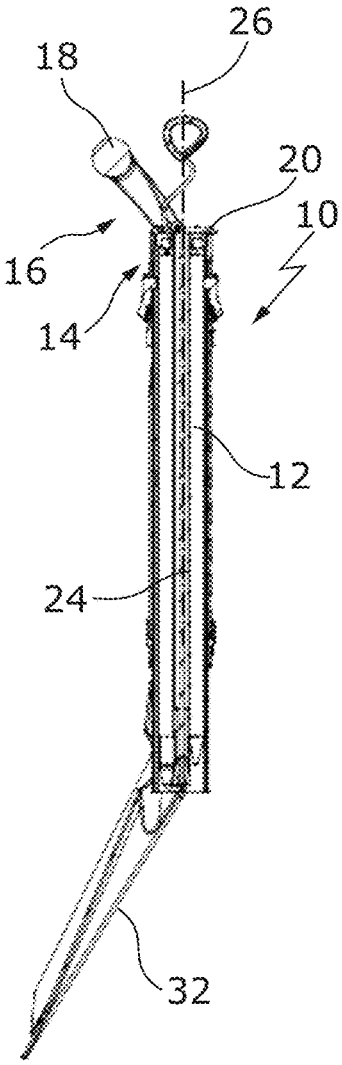
Figure 4:
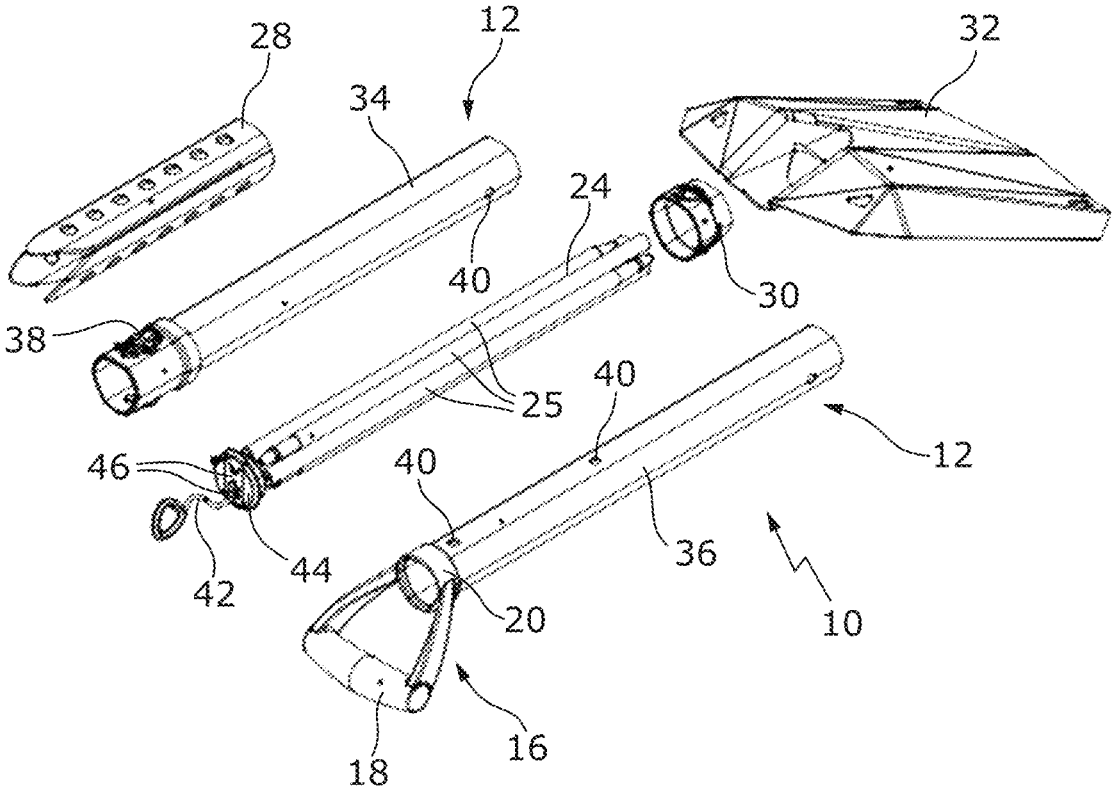
Figure 5:
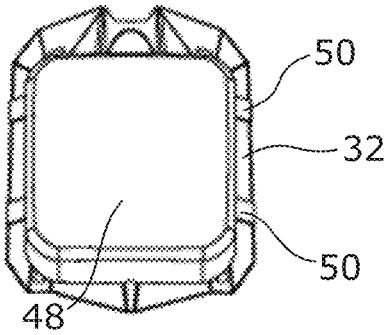
Figure 6:
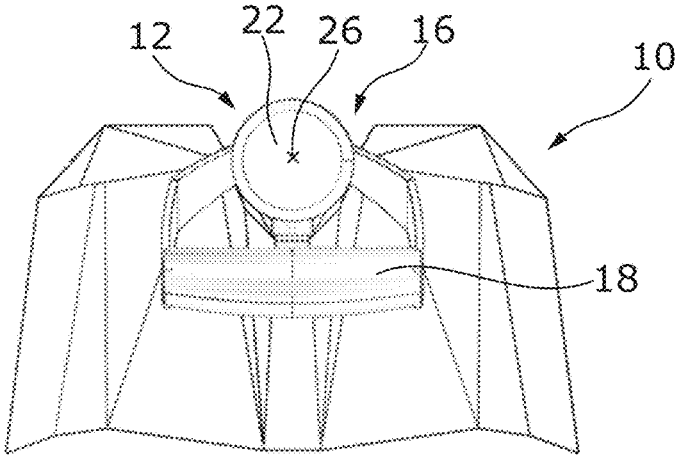
Figure 7:
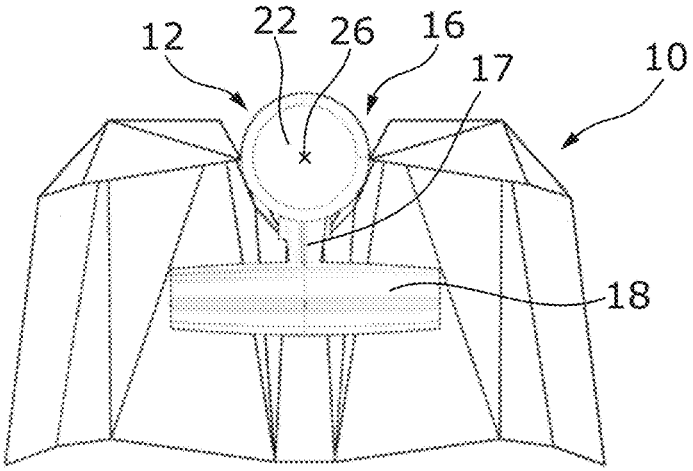
Figure 8:
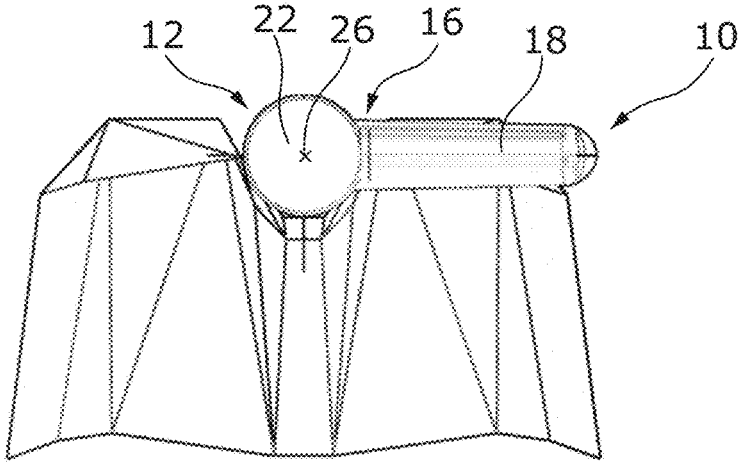
Figure 9:
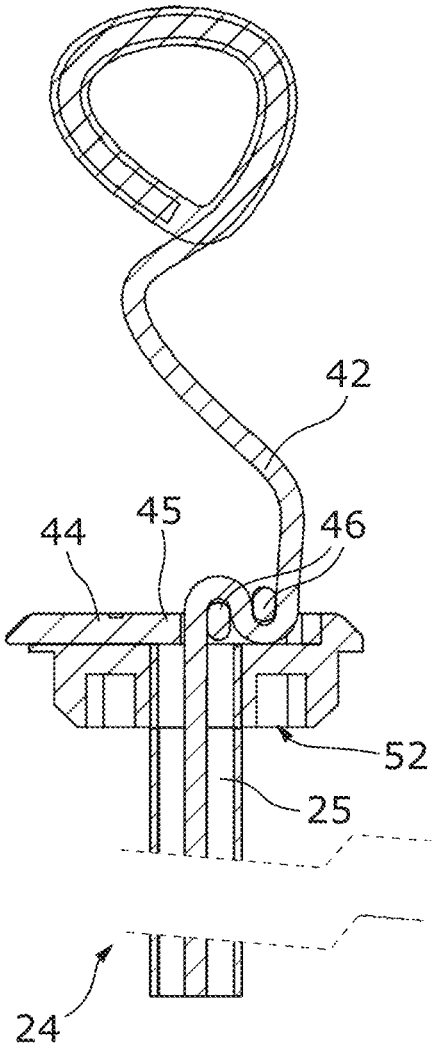
Figure 10:
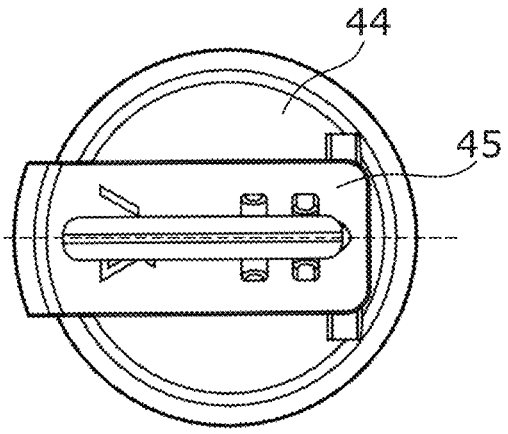
Figure 11:
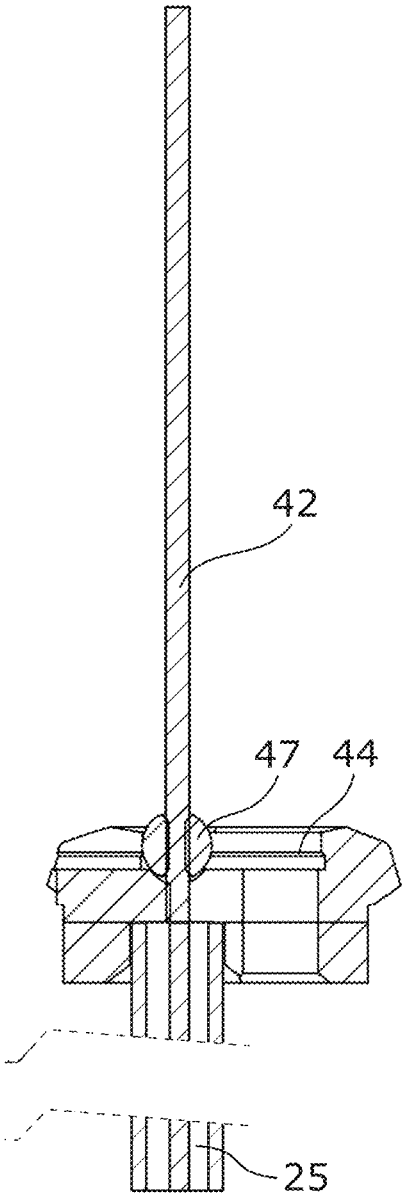
Figure 12:
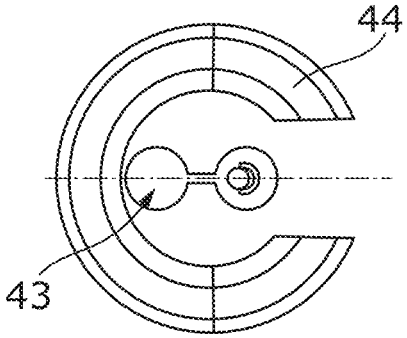

The shaft part 34 can also be seen. As will be explained in more detail below, the shaft 12 (FIG. 1) is variable in length, in particular telescopic. It can be fastened at different relative lengths by means of the fastening device 38.

The fastening device 38 exhibits a latching mechanism or forms one. For this purpose, it exhibits a clasp 39. The clasp 39 is designed as a metal clip. It externally encompasses the shaft part 34. The clasp 39 is also non-circular in cross section, in particular, it is essentially designed as an oval.

The shaft part 34 exhibits a fastening recess 40 into which the clasp 39 engages by means of a raised section 37. The raised section 37 has an increased height so that it can engage in a fastening recess of a further shaft part (not shown in FIGS. 13 and 14) which is inserted into the shaft part 34 and can thus fix the further shaft part on the shaft part 34.

The clasp 39 is fastened to the shaft part 34 with a fastening element, in particular a rivet 41.

By pressing the clasp 39 along its longer diameter, the raised section 37 can thus be lifted off the shaft part 34. By releasing, the raised section 37 engages again in the shaft part 34 and possibly in the further shaft part, so that the shaft part 34 can be latched in place with the further shaft part. Since the clasp 39 is externally arranged on the shaft, it can even be operated with gloves, in particular it can be compressed.

Figure 14:
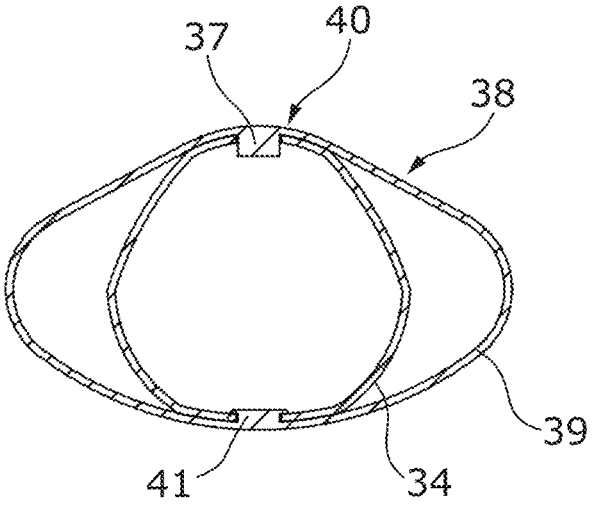
FIG. 14 shows the fastening device 38 of FIG. 13 as a cross-sectional view.

In order to facilitate the latching, the shaft part 34 is shaped in a non-circular, in particular oval, cross section, as can be seen in particular from FIG. 14.

Figure 13:
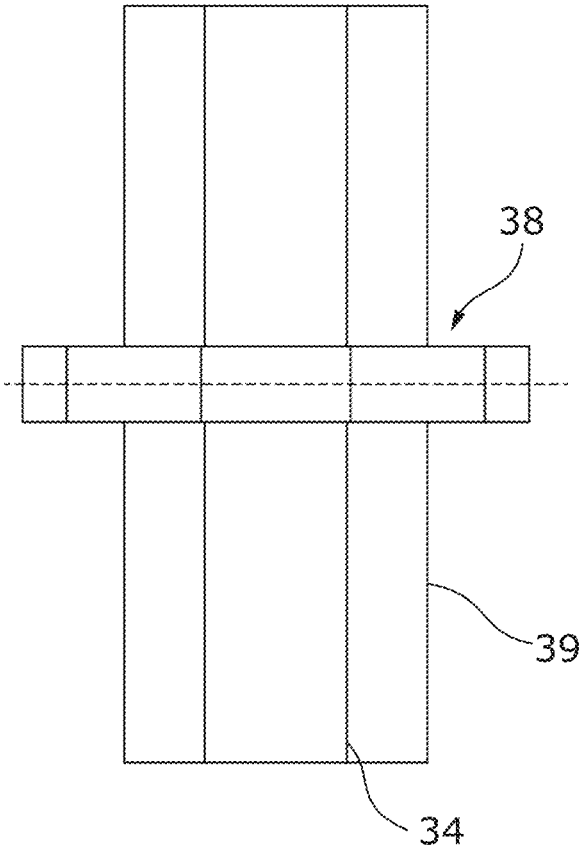
FIG. 13 shows a longitudinal sectional view of a fastening device 38.
Figure 15:
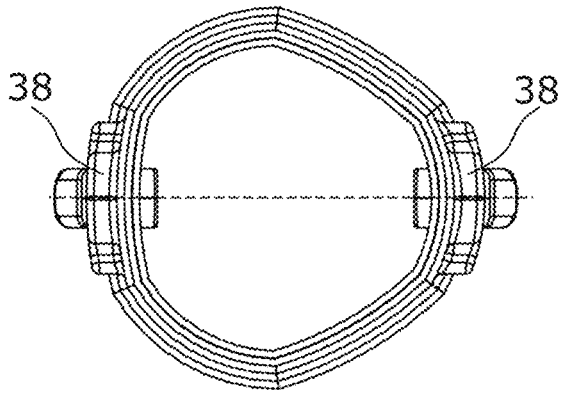
Figure 16:
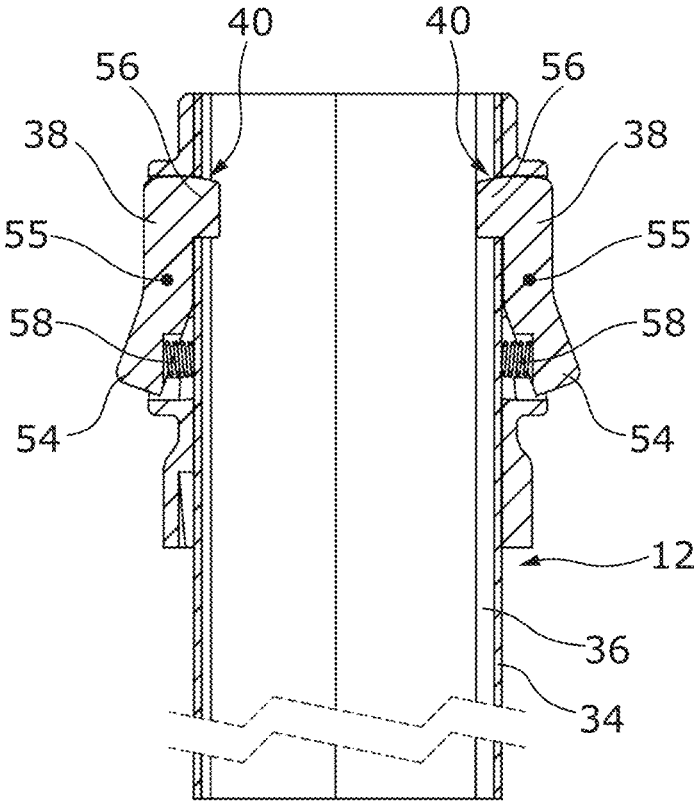

FIG. 15 shows a cross-sectional view of two fastening devices 38, which are designed as an alternative to the fastening device 38 of FIGS. 13 and 14. FIG. 16 shows the fastening devices 38 of FIG. 15 in longitudinal section.

One can also see the shaft part 34 into which a further shaft part 36 is inserted. In the state shown in FIGS. 15 and 16, the two shaft parts 34, 36 are already latched together.

The fastening devices 38 have tilting elements 54, which are each mounted on a bearing 55. At one end, the tilting elements 54 exhibit bolts 56. At the other end, the tilting elements are each pushed away from the shaft 12 by a spring element 58.

The bolts 56 can pass through the fastening recesses 40 of the shaft part 34 and thus fix or latch the first and the second shaft parts 34, 36 to one another.

It should be recognized that the fastening devices 38 can be actuated by pressure on the spring-side end of the tilting element 54. Thus, the fastening devices 38 on the outside of the shaft can also be operated with gloves even in this exemplary embodiment.

By actuating the fastening device 38, the respective bolt 56 at least partially clears the fastening recess 40, so that the shaft parts 34, 36 can be displaced relative to one another. In other words, the fastening devices 38 each form a latching mechanism.

It can also be seen that the fastening device 38 protrudes only slightly into the inner region of the shaft 12. Most of the interior of the—hollow—shaft 12 thus remains free to receive the avalanche probe 24.

It goes without saying that a plurality of fastening recesses 40 can be provided along the shaft 12, so that the length of the shaft 12 can be adjusted to at least several predetermined lengths. The shaft 12 is thus telescopic.

Figure 17:
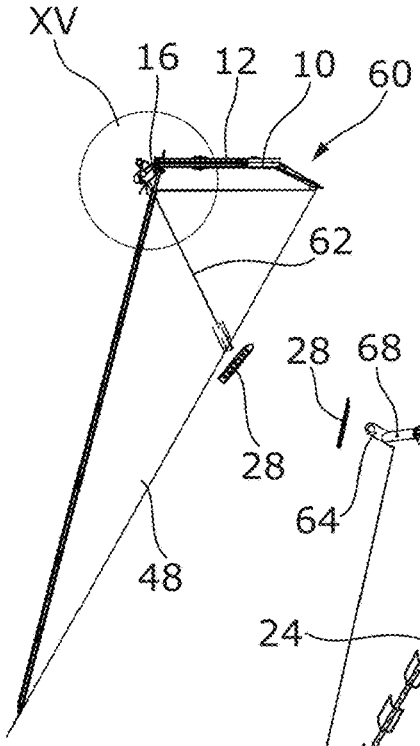
Figure 18:
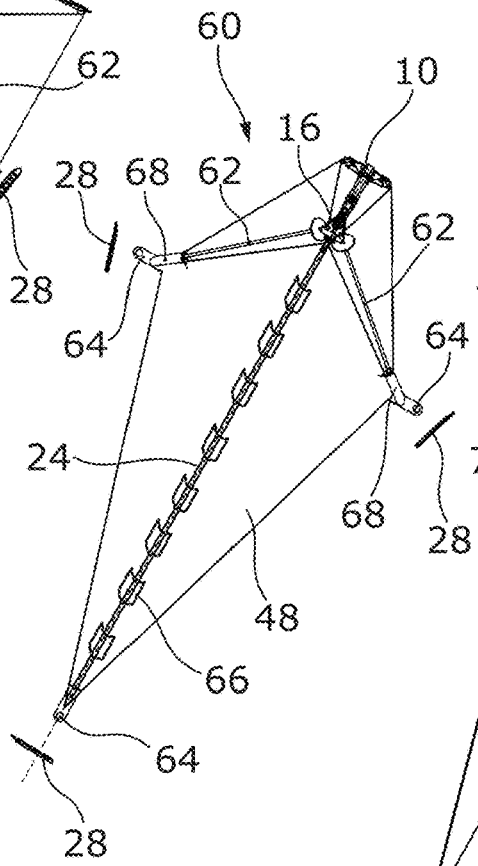
Figure 19:
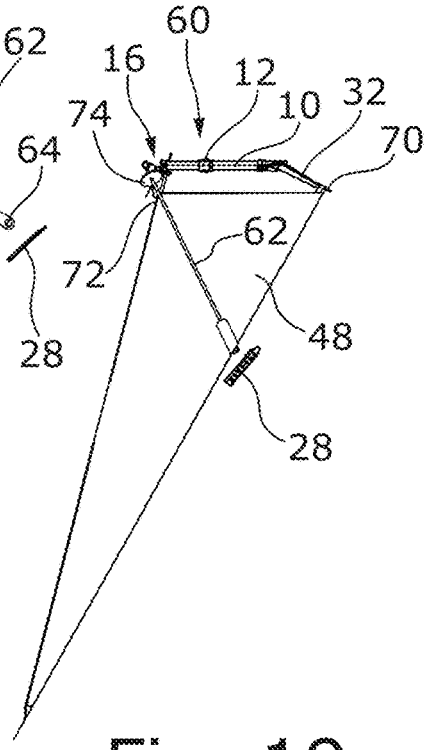

FIGS. 17, 18 and 19 show a tent 60 constructed with the avalanche shovel 10. FIG. 18 shows the tent 60 in a view from above, whereas FIGS. 17 and 19 each show a sectional or side view of the tent 60.

The tarpaulin 48 is tensioned by means of the avalanche shovel 10, two ski poles 62 and the avalanche probe 24. The ski poles 62 and the avalanche probe 24 are received in straps 64 or clasps of the tarpaulin 48. Furthermore, the snow anchors 28 can be seen, which can be introduced into corresponding recesses in the straps 64 for anchoring the tent 60 in the ground or snow.

The avalanche shovel 10 is used as follows to set up the tent 60 or as a tent pole:

First, the tarpaulin 48 is unpacked, placed on the ground and fastened with at least one of the snow anchors 28.

The tarpaulin 48 exhibits a plurality of slots 66 through which the avalanche probe 24 is inserted. Now the ski poles 62 are inserted with their grip side in slots 68 of the straps 64.

Figure 21:
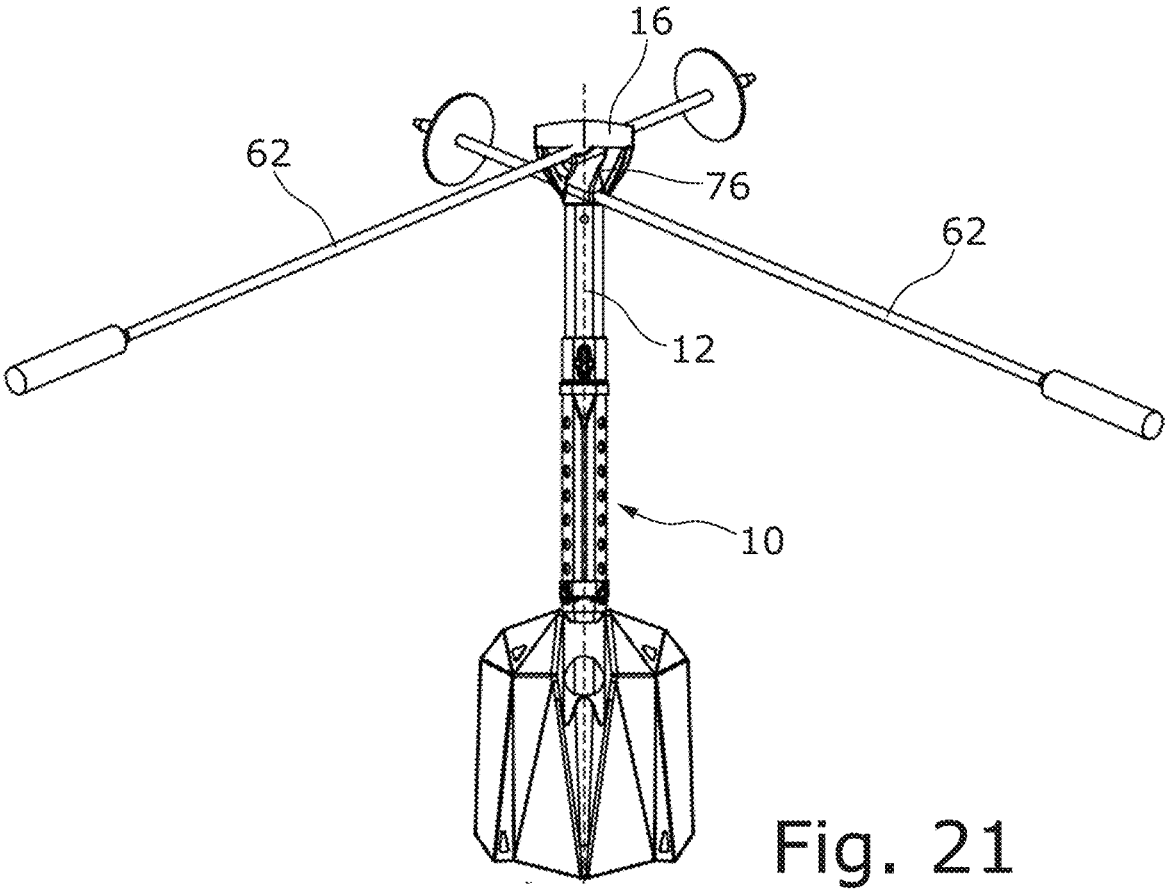

The avalanche shovel 10 is inserted with its blade surface 32 into a further slot 70 (see in particular FIG. 21).

As will be shown in more detail below, the basket ends of the ski poles 62 are connected to the grip section 16 of the avalanche shovel 10.

Before this—especially depending on the size of the tarpaulin 48—the shaft 12 can be telescoped or its length adjusted.

Finally, the tent 60 is erected by means of a strap 72 and attached to the grip section 16. As an alternative to the straps, the attachment between the tent and the probe can also be carried out in the form of clasps, which are hung in the probe after erection. The tent 60 is tensioned by means of a further strap 74. By changing the length of the straps 72, 74, in particular the strap 74, the tent can be adapted to different lengths of the ski poles 62 or to different types of ski poles 62.

Figure 20:
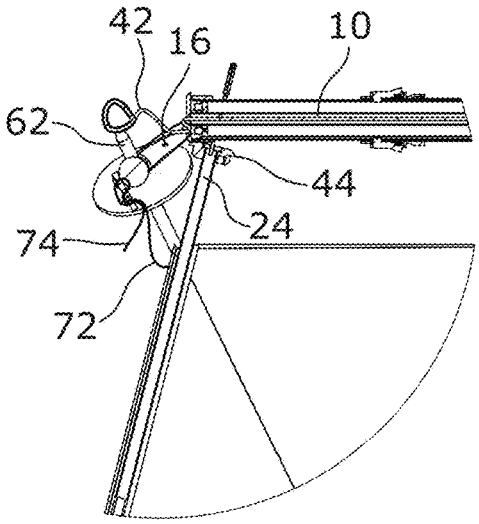

FIG. 20 shows a detailed view according to section XV of FIG. 17. It can, in particular, be seen that the basket end of the ski pole 62 is fastened to the grip section 16 of the avalanche shovel 10, in particular with the aid of the straps 72, 74.

The ski poles 62 are fastened by means of connecting elements which are explained in more detail in the following figures.

Figure 22:
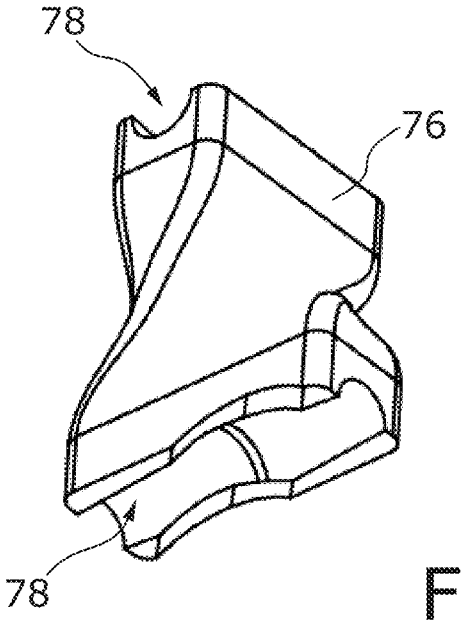

A first connecting element 76 is shown in FIGS. 21 and 22. The first connecting element 76 can be inserted into the grip section 16 or, in the state shown in FIG. 21, inserted, in particular, clamped, into the grip section 16 of the avalanche shovel 10.

In an alternative embodiment, it is provided that such a first connecting element 76 is formed on the grip section 16 and/or on the shaft 12.

As can, in particular, be seen from FIG. 22, the first connecting element 76 exhibits two receptacles 78. In this exemplary embodiment, the receptacles 78 are each half-shell-shaped. They are aligned at an angle, in particular perpendicular, to one another. The inner diameters of the receptacles 78 are adapted to the diameters of the shafts of the ski poles 62 (see in particular FIG. 21). Thus, the ski poles 62 can be inserted into the receptacles 78 of the first connecting element in order to set up the tent and can be clamped against the grip section 16 of the avalanche shovel 10. Due to the angular alignment of the receptacles 78, the ski poles 62 and the avalanche shovel 10 are set up in a tripod shape.

Figure 23:
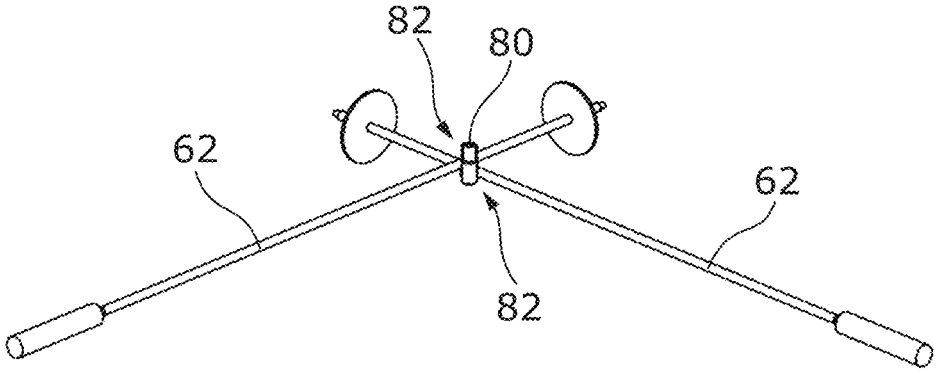
Figure 24:
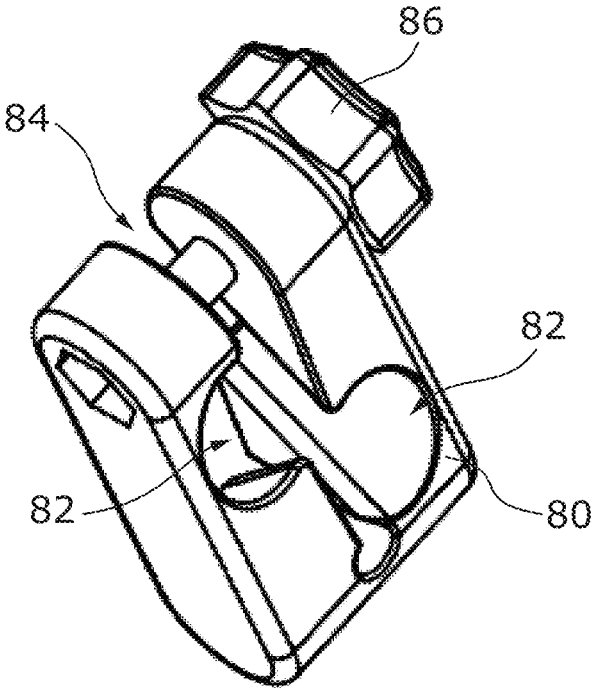

A second connecting element 80 is shown in FIGS. 23 and 24. It also exhibits two receptacles 82 for receiving the ski poles 62 (see in particular FIG. 25).

The second connecting element 80 exhibits a clamping gap 84, which is used by means of a clamping screw 86 to clamp the ski poles 62 accommodated in the receptacles 82.

With this second connecting element 80, the receptacles 82 also have different orientations. According to FIG. 23, the ski poles 62 are aligned with one another in a predefined direction by tightening the clamping screw 86 (FIG. 24).

Figure 25:
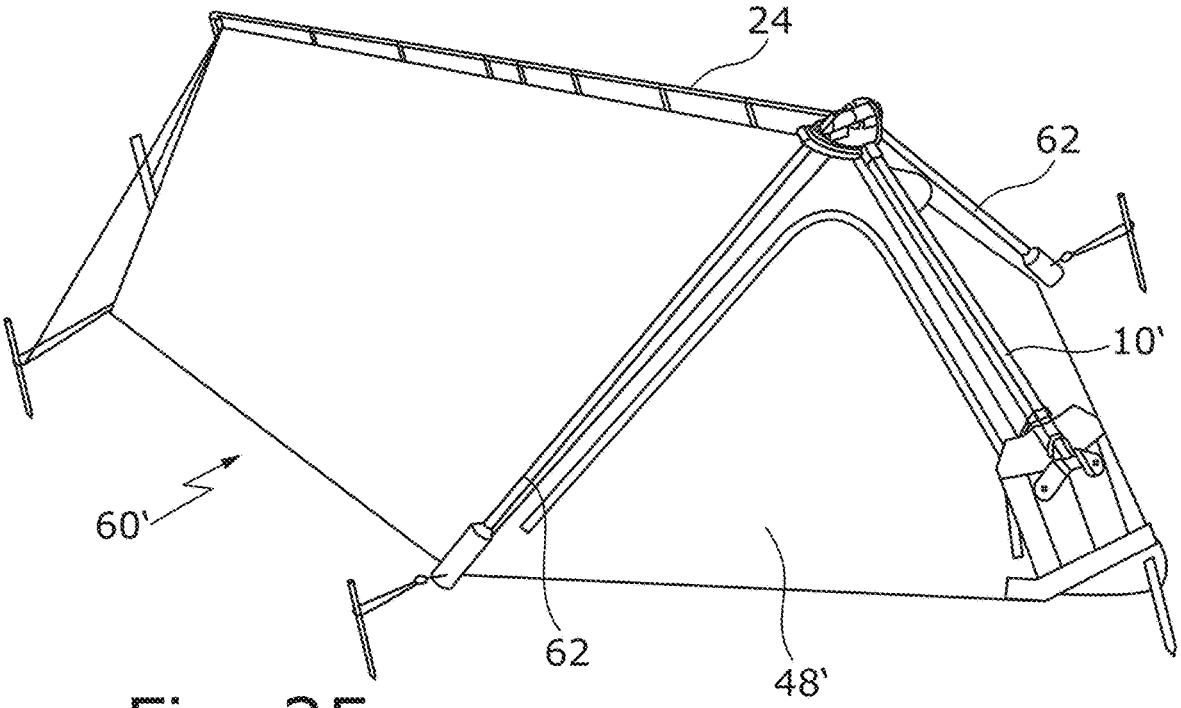

FIG. 25 shows a second tent 60' which, like the tent 60 from FIGS. 17 to 19, is tensioned by means of two ski poles 62, an avalanche shovel 10' and an avalanche probe 24. Since the ski poles 62 can have different lengths, the avalanche shovel 10' forms different angles with the poles 62. It is therefore necessary to provide an angle compensation for the tent attachment if the tent 60' is to be optimally tensioned.

Figure 26:
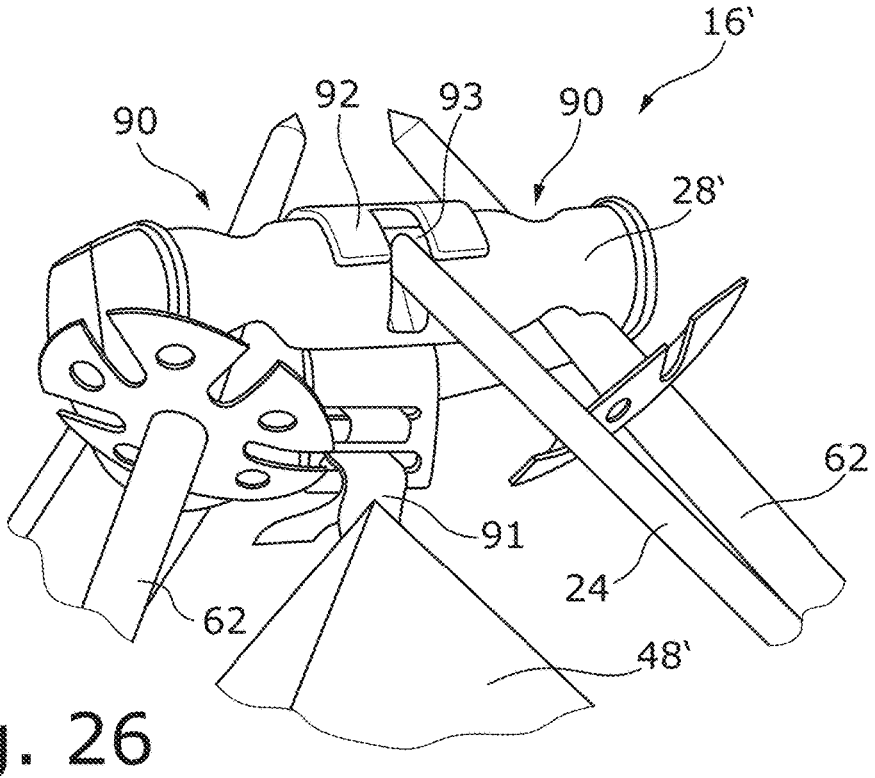

As illustrated in FIG. 26, the angle compensation is implemented in a grip area 16' of the avalanche shovel 10'. The grip area 16' exhibits a grip section 28, in which two through openings 90 are provided for the tips of the ski poles 62. These through openings 90 can also be designed with a constriction for the clamping reception of the ski pole tips. The tarpaulin 48' is provided with a strap 91 which is attached to a hook-shaped element 92 so as to be adjustable in length. The hook-shaped element 92 can be clipped onto the grip section 28' and can then be rotated on the surface thereof. In this way, an angle compensation between the strap 91 and the shovel 10' can take place when using ski poles 62 of different lengths. The avalanche probe 24 is mounted in a bore in a cylindrical element 93 which is rotatable in the inside of the grip section 28'. The angle between the avalanche probe 24 and the shovel 10' can thus also be adapted to different lengths of ski poles 62, for example, in an angular range of ±15°. This can ensure that the avalanche probe 24, to which the upper edge of the tarpaulin 48' is attached, is always aligned horizontally and thus the tent 60' achieves its optimal interior volume.

What is claimed is:

1. An avalanche shovel (10) comprising:

a shaft (12) having a grip section (16) that is formed and/or arranged at one shaft end (14), and an avalanche probe (24) which is configured to be arranged in the shaft (12) of the avalanche shovel (10), wherein the grip section (16) has a grip area (18) for gripping and/or holding the avalanche shovel (10) and/or such a grip area (18) is formed on the grip section (16), wherein the grip section (16) has an insertion and/or removal opening (22) for removal of the avalanche probe (24) from the shaft (12) and/or for insertion of the avalanche probe (24) into the shaft (12) along an insertion axis (26), and wherein a cap (44) is arranged and/or formed at one end of the shaft (12), in a region of the insertion and/or removal opening (22).

2. The avalanche shovel according to claim 1, wherein the grip area (18) is arranged and/or formed outside the insertion axis (26).

3. The avalanche shovel according to claim 1, wherein the grip section (16) is D-shaped or T-shaped.

4. The avalanche shovel according to claim 1, wherein the shaft (12) is variable in length.

5. The avalanche shovel according to claim 1, wherein the shaft (12) is telescopic and is configured to be locked in different length positions.

6. The avalanche shovel according to claim 5, wherein the shaft (12) has a fastening device (38) designed as a latching mechanism for setting different lengths of the shaft (12).

7. The avalanche shovel according to claim 6, wherein the fastening device (38) is configured to be actuated from an exterior side of the shaft (12).

8. The avalanche shovel according to claim 1, wherein the avalanche probe (24) is constructed in several parts.

9. A tent (60), with a tarpaulin (48) and at least one tent pole, wherein the tent pole is formed from or encompasses the avalanche shovel (10) according to claim 1.

10. The tent according to claim 9, wherein at least one further tent pole is formed from or comprises the avalanche probe (24) of the avalanche shovel (10).

11. The tent according to claim 9, wherein at least one further tent pole is formed from or comprises a ski pole (62).

12. The tent according to claim 9, wherein the tarpaulin (48) has at least one pole receptacle configured for holding an avalanche probe (24) and/or a ski pole (62).

13. The tent according to claim 9, wherein the tent has at least one length-adjustable strap (64, 72, 74).

14. The tent according to claim 13, wherein the strap is fastened in a length-adjustable manner to a hook-shaped element and the hook-shaped element is configured to be clipped onto a receptacle of a grip section or onto a grip section of the avalanche shovel (10).

15. An avalanche shovel (10) comprising:

a shaft (12) having a grip section (16) that is formed and/or arranged at one shaft end (14), and an avalanche probe (24) which is configured to be arranged in the shaft (12) of the avalanche shovel (10), wherein the grip section (16) has a grip area (18) for gripping and/or holding the avalanche shovel (10) and/or such a grip area (18) is formed on the grip section (16), wherein the grip section (16) has an insertion and/or removal opening (22) for removal of the avalanche probe (24) from the shaft (12) and/or for insertion of the avalanche probe (24) into the shaft (12) along an insertion axis (26), wherein the grip section (16) of the avalanche shovel (10) has at least one receptacle (78, 82) for the mounted avalanche probe (24) and/or for a ski pole (62) and/or for an ice axe, and/or wherein such a receptacle (78, 82) is formed on the grip section (16), and wherein a connecting element is arranged or is configured to be arranged on the receptacle, wherein the connecting element is configured for connecting and fastening several stick-shaped objects to each other at the grip section of the avalanche shovel.

16. The avalanche shovel according to claim 15, further comprising a hook-shaped element that is configured to be clipped onto the receptacle or the grip section, to which a strap fastened to a tent can be attached in a length-adjustable manner.

17. An avalanche shovel (10) comprising:

a shaft (12) having a grip section (16) that is formed and/or arranged at one shaft end (14), and an avalanche probe (24) which is configured to be arranged in the shaft (12) of the avalanche shovel (10), wherein the grip section (16) has a grip area (18) for gripping and/or holding the avalanche shovel (10) and/or such a grip area (18) is formed on the grip section (16), wherein the grip section (16) has an insertion and/or removal opening (22) for removal of the avalanche probe (24) from the shaft (12) and/or for insertion of the avalanche probe (24) into the shaft (12) along an insertion axis (26), wherein the grip section (16) of the avalanche shovel (10) has at least one receptacle (78, 82) for the mounted avalanche probe (24) and/or for a ski pole (62) and/or for an ice axe, and/or wherein such a receptacle (78, 82) is formed on the grip section (16), and wherein the avalanche probe (24) is configured to be pivotally attached to the receptacle or the grip section.

18. An avalanche shovel (10) comprising:

a shaft (12) having a grip section (16) that is formed and/or arranged at one shaft end (14), and an avalanche probe (24) which is configured to be arranged in the shaft (12) of the avalanche shovel (10)

wherein the grip section (16) has a grip area (18) configured for gripping and/or holding the avalanche shovel (10) and/or such a grip area (18) is formed on the grip section (16), wherein the grip section (16) has an insertion and/or removal opening (22) for removal of the avalanche probe (22) from the shaft (12) and/or for insertion of the avalanche probe (24) into the shaft (12) along an insertion axis (26), and wherein the avalanche shovel (10) has at least one snow anchor.

19. The avalanche shovel according to claim 18, wherein the snow anchor (28) is arranged on or in the shaft (12).

20. The avalanche shovel according to claim 18, wherein the snow anchor (28) is fastened with a sleeve (30).

* * * * *